US008974075B2

(12) United States Patent
Opolka

(10) Patent No.: US 8,974,075 B2
(45) Date of Patent: Mar. 10, 2015

(54) FOCUSABLE FLASHLIGHT

(75) Inventor: Rainer Opolka, Solingen (DE)

(73) Assignee: Zweibrueder Optoelectronics GmbH, Solingen (DE)

( * ) Notice: Subject to any disclaimer, the term of this patent is extended or adjusted under 35 U.S.C. 154(b) by 385 days.

(21) Appl. No.: 13/187,639

(22) Filed: Jul. 21, 2011

(65) Prior Publication Data

US 2012/0020062 A1 Jan. 26, 2012

(30) Foreign Application Priority Data

Jul. 23, 2010 (CN) ..... 2010 1 0236838

(51) Int. Cl.
*F21L 4/04* (2006.01)
*F21V 14/06* (2006.01)

(52) U.S. Cl.
CPC ..... *F21V 14/065* (2013.01)
USPC ..... 362/187; 362/186; 362/199; 362/277

(58) Field of Classification Search
USPC ..... 362/187, 188, 197–199, 282, 319, 32, 362/186
See application file for complete search history.

(56) References Cited

U.S. PATENT DOCUMENTS

| | | | | |
|---|---|---|---|---|
| 5,595,435 | A * | 1/1997 | Palmer et al. | 362/109 |
| 5,735,594 | A * | 4/1998 | Own | 362/202 |
| 7,040,775 | B2 | 5/2006 | Opolka | |
| 7,461,945 | B2 * | 12/2008 | Shiau | 362/187 |
| 7,473,007 | B1 * | 1/2009 | Wang | 362/187 |
| 2011/0080725 | A1 * | 4/2011 | Brands et al. | 362/187 |

* cited by examiner

*Primary Examiner* — Jong-Suk (James) Lee
*Assistant Examiner* — Leah S Macchiarolo
(74) *Attorney, Agent, or Firm* — Andrew Wilford

(57) ABSTRACT

A flashlight has a casing having a front end, a light source axially secured in the housing inward of the front end, and a two-part connecting sleeve forward of the light source and having a rear part secured in the housing and a front part. Interengaging formations couple the parts together for only limited axial movement relative to each other, but lock them rotationally and prevent axial separation beyond a predetermined limit. A lens is mounted in the front part. A head sleeve secured to the front part extends axially rearward over the front end of the casing so that relative axial movement of the front and rear parts axially shifts the lens relative to the source.

11 Claims, 2 Drawing Sheets

FOCUSABLE FLASHLIGHT

FIELD OF THE INVENTION

The present invention relates to a flashlight. More particularly this invention concerns a flashlight whose light beam can be focused.

BACKGROUND OF THE INVENTION

A typical flashlight has a casing, a light source and a power source in the casing, and a lens assembly mounted at a head end of the casing. The head-end lens assembly can be shifted longitudinally or axially of the casing relative to the light source to focus light emitted by the source into a controllable beam.

Such a flashlight as disclosed in U.S. Pat. No. 7,040,775 has a casing adapted to hold a battery, a battery-powered LED light source mounted on the casing and directed forward along an axis, and a holder sleeve axially displaceable on the casing forward of and relative to the LED light source. An image carrier, e.g. a slide or a mask, is fixed in the holder sleeve and axially aligned with the light source. An end piece on the casing forward of the LED light source and of the image carrier holds a lens. Thus axial displacement of the holder sleeve moves the image carrier relative to the light source and to the lens. For the displaceable support of the image carrier, in addition to the lamp head and the casing, at least three further connecting sleeves are provided, namely an adapter, a guide sleeve and a sliding sleeve, so that assembly of the flashlight is relatively complex.

Furthermore, flashlights are known in which the lamp head focuses the emitted light with a reflector it carries and the casing with the light source are connected to one another via a threaded connection such that the reflector and the light source can be displaced relative to one another by a rotary motion. However, this embodiment has the disadvantage that two hands are always required for focusing, the casing being held with one hand and the lamp head being rotated with the other hand.

OBJECTS OF THE INVENTION

It is therefore an object of the present invention to provide an improved focusable flashlight.

Another object is the provision of such an improved focusable flashlight that overcomes the above-given disadvantages, in particular that can be focused with one hand and for whose assembly only a small number of connecting sleeves is required.

SUMMARY OF THE INVENTION

A flashlight has according to the invention a casing extending along an axis and having a front end, a light source axially secured in the housing inward of the front end, and a two-part connecting sleeve forward of the light source and having a rear part secured in the housing and a front part. Interengaging formations couple the parts together for only limited axial movement relative to each other, but lock them rotationally and prevent axial separation beyond a predetermined limit. A lens is mounted in the front part. A head sleeve secured to the front part extends axially rearward over the front end of the casing so that relative axial movement of the front and rear parts axially shifts the lens relative to the source. The result is a particularly compact focusable flashlight that is is easy to manufacture and easy to operate. Due to the low number of components used, assembly costs are also reduced.

Further preferred embodiments of the present invention are described below as well as in the subordinate claims. According to a first embodiment, the parts are cylindrically tubular and each have respective screwthreads that join them to complementary screwthreads on the lamp head and casing. Alternatively, the parts can also be connected via a bayonet or another detachable connection, such as, for example, a locking connection, to the casing or to the lamp head. However, a threaded connection is preferred due to the ease of production and assembly.

So that the lamp head can be displaced with respect to the casing, one part has at least one slide arm or guide that extends longitudinally axially and engages a slide surface or arm embodied on the other part. Preferably, the slide arm is of in a cylindrical or partly cylindrical shape. In an embodiment with a cylindrical slide arm, the other part is preferably annular and, guides are provided between the annular part and the guide, so that rotary movement of the annular part is prevented. In an embodiment with a plurality of partially cylindrical slide arms, they are preferably spaced equiangularly. The number of slide arms can vary depending on the size of the flashlight, at least three slide arms and three guides are preferred.

So that the lamp head is not accidentally detached from the casing during focusing, a captive connection of the parts is provided in an advantageous manner, that is the two parts can move relative to each other, but full separation is impossible. To this end, the guide preferably has a stop and the slide arm has an enlarged head part. The relative movement of the parts with respect to one another is limited on the one hand by the confronting and axially engageable end faces of the parts themselves and on the other hand by the stop and the enlarged head part. In an embodiment with several slide arms, the expansions can be tangential, and in an embodiment with one annular slide arm, the enlarged head part can be an annular stop that forms a stop with the front side of the annular part. It is preferably provided that the guides are on the outside or the inside of the part. In particular with a single annular slide arm, the guide is arranged on the inside for reasons of construction. Otherwise, the thread is interrupted by the guides at least in some regions.

In order to prevent the lamp head from being accidentally displaced with respect to the casing and thus to the light source, one guide element is preferably arranged so that relative movement of the parts can be performed only against a force. In the simplest case the guide element is an O-ring of rubber or another elastic material, which on the one hand surrounds the casing and on the other hand is sized such that so great a friction is produced between the lamp head and the O-ring that the lamp head can be displaced only deliberately. A guide element of this type can be produced economically and is easily replaced in the case of wear. In addition, the guide element serves as a seal so that no dirt in the form of dust can into the lamp head.

The connecting sleeve is preferably make by injection molding of plastic or is produced from metal, in particular aluminum.

According to a further embodiment of the present is invention the light source is an LED carried on a holder plate. This holder preferably has electric contacts concentrically in a circular or annular layout on its rear face. These contacts are connected to corresponding electrical contacts of the batteries. Furthermore, the holder has on the rear side an annular mating surface formed of a heat-conducting material and is in abutment with the casing. The heat produced in the light source is hereby dissipated to the casing, which in particular increases the service life of the light source. Aluminum, brass or copper are in particular suitable as materials.

BRIEF DESCRIPTION OF THE DRAWING

The above and other objects, features, and advantages will become more readily apparent from the following description, reference being made to the accompanying drawing in which.

DETAILED DESCRIPTION

Figure 1:
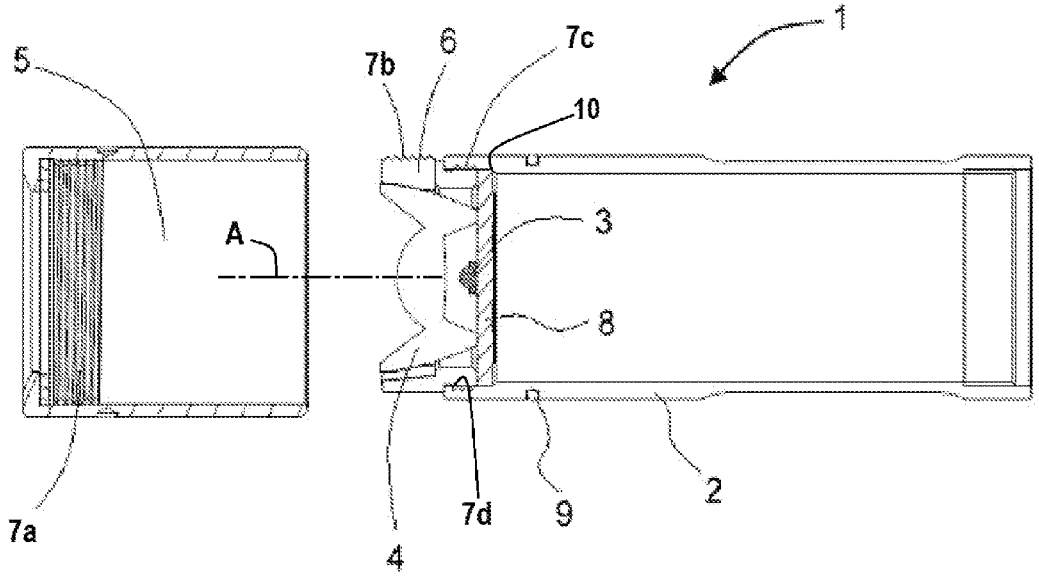
FIG. 1 is an axial section through a flashlight according to the invention with no batteries installed and in partially disassembled condition.
Figure 2:
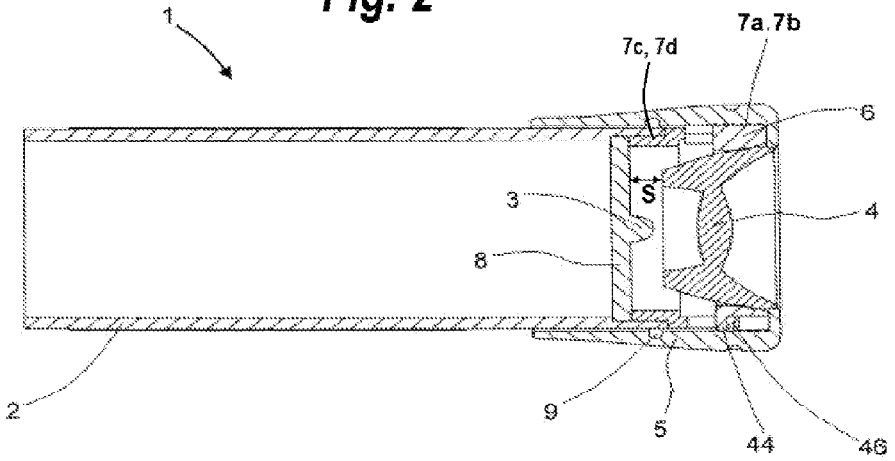
FIG. 2 is a view of a flashlight with no batteries or end cap in assembled condition.
Figure 3:
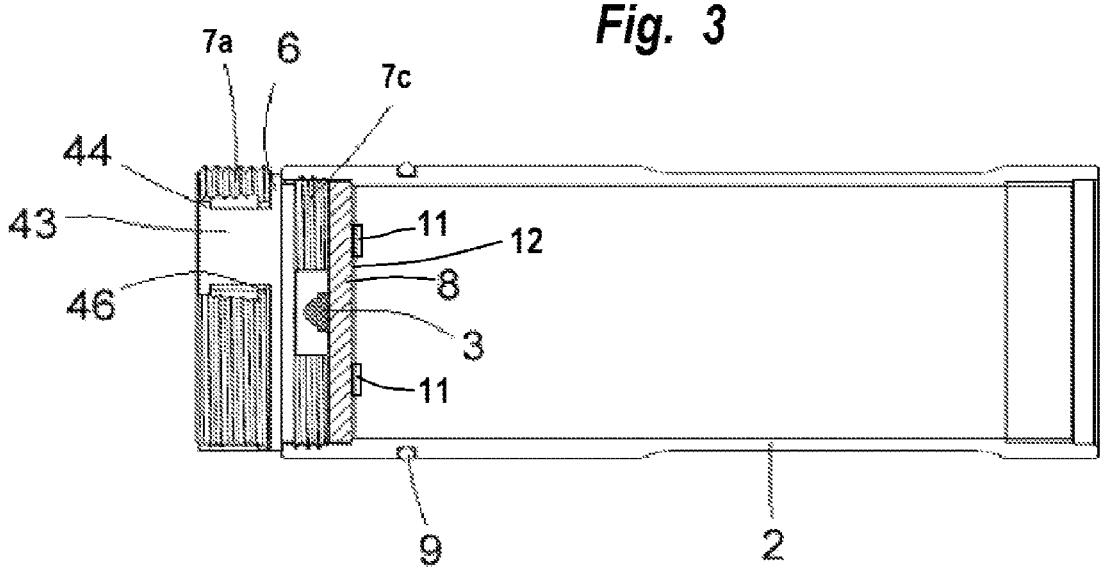
FIG. 3 shows the casing, light source, and connecting sleeve according to the invention.

As seen in FIGS. 1-3 a flashlight 1 according to the invention has a tubularly cylindrical casing 2 centered on an axis A, a light source 3, a lens 4 and a tubular head sleeve 5. A connecting sleeve 6 connected on the one hand to the casing 2 and on the other hand to the lamp head 5. To this end the sleeve 6 has an external screwthread 7*a* complementary to an internal screwthread 7*b* of the head 5 and an external screwthread 7*c* complementary to an internal screwthread 7*d* of the casing 2.

The light source 3 is carried on a holder disk 8 that is seated on a forwardly directed shoulder 10 of the casing 2. When assembled, the holder disk 8 is pressed by the connecting sleeve 6 onto the shoulder 10 and thus positively fixed in the casing 2, which forms a battery compartment rearward of this disk 8. Electrical contacts 11 as well as a heat-conducting surface 12 are provided on the back face of the holder 8.

The front end of the head 5 carries the lens 4 so that it can be longitudinally or axially steplessly displaced on the housing between the positions shown in FIGS. 1 and 2. In FIG. 1 the attachment lens system 4 bears against the holder plate or disk 8, whereas in FIG. 2 the disk 8 and the attachment lens system 4 are at a spacing S from each other. In order to prevent accidental shifting of the lamp head 5 and thus of the attachment lens system 4, an O-ring 9 is provided that is set in an outwardly pen groove on the casing 2 and bears elastically outward on an inner surface of the lamp head 5.

Figure 4:
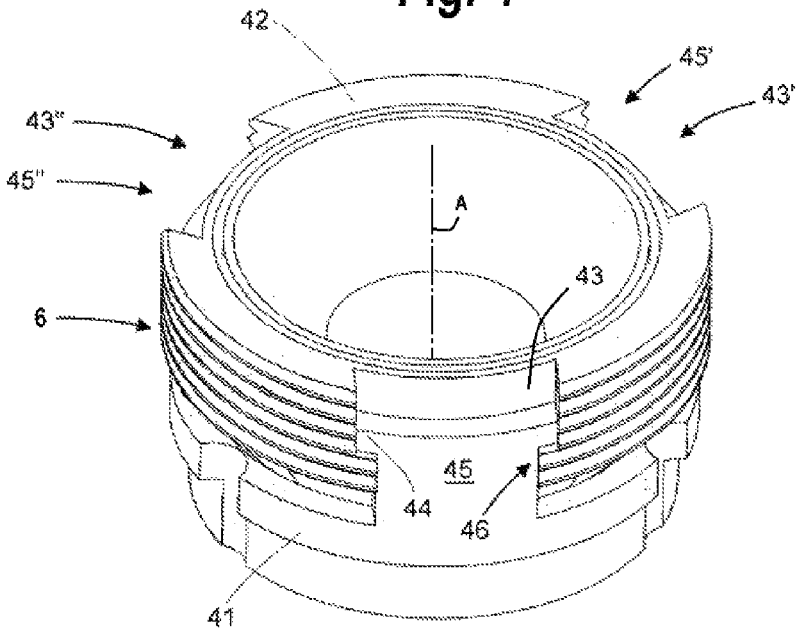
FIG. 4 is a lare-scale persopective view of the connecting sleeve.

In FIG. 4 the connecting sleeve 6 is shown to have two separate parts 41 and 42 that can move limitedly along the axis A relative to each other. To this end, the part 41 has three axially extending, angularly equispaced, and radially outwardly open guide grooves 43, 43', 43" each with a wide head region delimited by outwardly directed shoulders 46. The other part 42 has axially extending guide arms 45, 45', 45" axially slidable in the guide grooves 43, 43', and 43" and each having a widened head 44. The arms 45, 45', and 45" are sufficiently long that their heads 44 can shift axially in the respective grooves 43, 43', 43" outward of the shoulders 46. The heads 44 and the stops 46 abut each other when the parts 41 and 42 are displaced axially from one another to the maximum spacing S. At the same time, the interfit of the arms 45, 45', and 45" in the grooves 43, 43', and 43" rotationally couples the two parts 41 and 42 together to that they can be screwed into the casing 2 and into the head sleeve 5.

I claim:

1. A flashlight comprising:

a casing extending along an axis and having a front end formed with a screwthread;

a light source axially secured in the casing inward of the front end;

a connecting sleeve forward of the light source and formed by a rear part formed with a rear screwthread secured in the screwthread of the front end of the casing and a front part formed with a front screwthread and axially shiftable relative to the rear part, one of the front and rear parts being formed with an axially extending guide groove extending across and interrupting the respective screwthreads and the other of the front and rear parts being formed with an axially extending arm fitted in and axially slidable in the groove, the arm and the groove being of part-cylindrical section centered on the axis, the arm having remote from the other part a widened head region and the groove being formed with a complementary widened region in which the head region can slide axially for only limited axial movement of the front and rear parts relative to each other while inhibiting relative rotation of the front and rear parts;

a lens mounted in the front part; and a head sleeve having a screwthread secured to the front screwthread of the front part and extending axially rearward over the front end of the casing, whereby relative axial movement of the front and rear parts axially shifts the lens and the head sleeve relative to the source.

2. The flashlight defined in claim 1, wherein the front and rear screwthreads of the front and rear parts are external and the screwthreads of the casing and head sleeve are internal.

3. The flashlight defined in claim 2, wherein the arms extend axially forward from the rear part and the groove is formed in the front part.

4. The flashlight defined in claim 3, wherein the groove is a radially outwardly open.

5. The flashlight defined in claim 1, wherein there are a plurality of the arms and respective grooves that are angularly equispaced.

6. The flashlight defined in claim 1, wherein the groove is radially outwardly or inwardly open.

7. The flashlight defined in claim 1, wherein the front and rear parts are made of plastic or aluminum.

8. The flashlight defined in claim 1, wherein the light source includes a holder plate gripped axially between the rear part and the casing and an LED lamp on an outer face of the holder plate.

9. The flashlight defined in claim 8, wherein the holder plate is provided on its rear face with at least one electrical contact connected to the lamp.

10. The flashlight defined in claim 8, wherein the casing is formed with an axially forward directed shoulder against which the rear part presses the plate.

11. The flashlight defined in claim 10, wherein the plate is thermally conductive and the casing is of metal, whereby heat from the LED lamp is conducted by the plate to the casing.

* * * * *